United States Patent [19]

Drnevich

[11] Patent Number: 4,901,796

[45] Date of Patent: Feb. 20, 1990

[54] WELL PACKING SYSTEM

[75] Inventor: Raymond F. Drnevich, Clarence Center, N.Y.

[73] Assignee: Union Carbide Corporation, Danbury, Conn.

[21] Appl. No.: 286,174

[22] Filed: Dec. 19, 1988

[51] Int. Cl.[4] ..... E21B 43/04; E21B 35/00

[52] U.S. Cl. ..... 166/278; 166/57

[58] Field of Search ..... 166/57, 256, 276, 278, 166/303, 228; 169/69

[56] References Cited

U.S. PATENT DOCUMENTS

| | | | |
|---|---|---|---|
| 3,456,735 | 7/1969 | McDougall et al. | 166/57 X |
| 4,008,763 | 2/1977 | Lowe, Jr. | 166/278 X |
| 4,623,021 | 11/1986 | Stowe | 166/278 X |

*Primary Examiner*—William P. Neuder

*Attorney, Agent, or Firm*—Stanley Ktorides

[57] ABSTRACT

The present invention pertains to a packing structure and method of packing which can be used in the wellbore of injection wells for the recovery of heavy oils, shale oils, and tars, and in well shafts for in-situ coal gasification. The packing can also be used in the wellbore of gas and light oil production wells. The packing is used to provide passive protection of well structural components in the event of a well fire or fire in the formation near the well.

The packing is placed in the well shaft below ground level, and preferably below the well packer. The packing particle size, as related to the well casings, is a critical feature of the invention. Particle size distribution, and position of placement of packing in the wellbore as a function of packing particle size, are significant variables which can be tailored to the application. The packing material is non-combustible under anticipated conditions which will occur in the well in the event of a fire and can be endothermic to provide increased efficiency.

14 Claims, 8 Drawing Sheets

WELL PACKING SYSTEM

BACKGROUND OF THE INVENTION

1. Field of the Invention

The present invention pertains to packing which can be used in injection wellbores which facilitate the recovery of heavy oils, shale oils, tars, and in well shafts for in situ coal gasification. The packing can also be used in light oil and gas production wells. The packing is used to control the quantity of hydrocarbons in the wellbore of a producing well; to limit the backflow of hydrocarbons into and reduce space available to hydrocarbons within the wellbore of an injection well; and, to act as a heat sink in all applications, preventing damage to well components in case of a well fire or combustion in the immediate area of the well.

2. Background of the Invention

In situ combustion is a generic term used to describe burning of hydrocarbons in a subterranean formation. In situ combustion, in the form of fire flooding, is generally used in enhanced recovery of heavy oils and tar sands, and can be used in the recovery of light oils. In situ combustion can also be used for retorting oil shale.

The well packing system of the present invention, although focused on in-situ combustion for heavy oil recovery, is also applicable to tar sands, shale oil and light oil. The packing can also be used in well shafts for in-situ coal gasification processes.

The in situ combustion process for enhanced heavy oil recovery is a thermal recovery technique in which a burning fuel front is initiated in the oil-containing formation near an injection well and is used to push heated oil toward production wells. Typically, the formation in which the oil lies is preheated with steam or a type of downhole heater; then oxygen containing gas (frequently air), is injected into the formation. Ideally, ignition of the oil in the formation occurs evenly across the deposit face and as the oxygen-containing gas injection continues, the hydrocarbons around the injection well are burned at a controlled rate to ensure integrity of the injection well until the burning front is moved some distance from the well.

However, ideal operations are seldom realized. Formation heterogeneities and gas supply problems can result in temperatures in and around the injection well that are sufficiently high to adversely affect the structural integrity of the well casing and other down-hole equipment. When the oxygen containing gas is oxygen enriched air, carbon steel equipment can ignite and burn. Damage from injection well fires can cost $100,000 per well or more to repair.

FIG. 1 shows a schematic of a typical injection well 10 for in situ combustion enhanced oil recovery. Generally, all the below ground 12 tubulars such as surface casing 14 (which extends above ground), casing 16, and tubing 18, for example, are carbon steel The packer 22, used to isolate the annulus 28 from injection region 30 and from hydrocarbon-containing formation 26, is also commonly comprised of carbon steel and has elastomeric seals 20.

Techniques used to mitigate the problem of injection well fires by protecting well equipment from damage include (1) use of alloys for fabrication of the tubulars and packer;(2) "fail safe" inert gas or water dump systems, including down hole temperature measurement devices connected with the inert gas or water dump system;(3) use of down-hole temperature measurement as part of a shut off system for the oxygen-containing injection gas; and (4) combinations of these techniques.

The cost of alloys such as Incoloy 825 and Monel which are used to replace carbon steel is about 20 to 40 times the cost equivalent of the carbon steel. Even when alloy use is restricted to lower casing 24, packer 22 and other equipment below packer 22, the use of alloy material increases well costs over the range of about $10,000 to $50,000 per well. In addition, the use of alloys does not prevent overheating of the packer 22 in the event of a well fire, and such heating can cause a change in the properties of the elastomeric seal 20, and loss of the seal between the annulus 28 and injection region 30 of the well.

Water is often used in the annulus 28 region to keep packer 22 cool and to act as a quench if the well becomes hot enough to affect elastomer seals 20. However, even a "fail safe" dump system may not provide sufficient protection for tubulars down hole of packer 22. In addition, "fail safe" systems which use water or inert gas (such as nitrogen) for quenching are not always reliable. The down hole temperature sensing devices used to initiate the "fail safe" systems are unreliable for long term use due to the environment in which they are placed. In addition, the response of the dump system may be too slow to prevent damage to the equipment.

The risk of high down-hole temperatures is increased in oxygen-enriched air or oxygen fire floods because of the increase in combustion rate with increased oxygen content. At oxygen concentrations greater than about 40%, sufficient energy can be released to ignite and burn carbon steel tubulars.

As the combustion zone in an in-situ combustion process nears the production wells, the oil is heated to its autoignition temperature. When the oxygen containing gas enters the production well through the formation, spontaneous combustion occurs and extremely high temperature levels result. Down hole thermocouples can be used to sense the approach of the combustion front in time to permit use of a water dump system. However, such systems are expensive, may fail to adequately respond, and traditionally have not been used. Thus, the production well is at risk in a manner similar to the injection well.

The following art is related to the technology discussed above:

Allen, T. O. and Roberts, A. P., "Production Operations", Second Edition, Oil and Gas Consultants International, Inc., Tulsa, Okla., (1982), Volume 2, pp. 35–31 discusses the problem of sand control within production oil wells and describes many of the common designs of oil well packing currently used to hold formation sand in place, preventing the influx of sand into the well without excessive reduction in well productivity. The design includes methods of sizing the packing relative to sand size, describes the kinds of materials commonly used, and discloses methods for placing packing inside the well.

G. Pusch, "Testing Oil Recovery Methods. In Situ Combustion with Oxygen Combined with Water Injection (ISCOWI)—A New Tertiary Oil Recovery Method", Eidoel Kohle, Erdgas, Petrochem Vol. 30, No.1, pp 13–25 (1977) describes the use of filling materials in reservoirs down-hole of the packer. Mr. Pusch states that he believes it is a basic precondition of the use of oxygen enriched air injection that free hollow spaces in the well, at least in the reservoir range below the packer, be filled with sand or gravel or porous cement, wherein sufficient permeability of the packing is maintained.

U.S. Pat. No. 4,583,594 to Kojicic, dated April 22, 1986 and Titled: Double Walled Screen-Filter with Perforated Joints, describes a pair of spaced concentric screens connected with perforated joints closing the lower end of the filtering space. The annular space is filled with a filtering materials pack comprising gravel or synthetic balls. An upper joint acts as a cover cap of the annular filtering space to seal the filtering materials pack.

U.S. Pat. No. 4,042,026 to Pusch et al., dated Aug. 16, 1977, and Titled: Method for Initiating an In-Situ Recovery Process by the Introduction of Oxygen, describes a method for initiating an in situ recovery process or for restarting the operation in a subterranean formation by the introduction of oxygen into the formation. The cavities of the reservoir region within the injection bore hole (in which contact between oxygen and combustible materials is possible) are filled with porous filling material, such as sand, grit packing or Raschig rings.

U.S. Pat. No. 3,010,516 to Schleicher, dated Nov. 28, 1961, and Titled: Burner and Process for In Situ Combustion, discloses a porous refractory burner used to combust injected gas mixtures within the pores of the burner.

U.S. Pat. No. 2,777,679 to Ljungstrom, dated Jan. 15, 1957, and Titled: Recovering Sub-Surface Bituminous Deposits by Creating a Frozen Barrier and Heating In Situ, describes the use of granular material such as sand in the annular region above the well packer.

U.S. Pat. No. 2,119,563 to Wells, dated June 7, 1938, and Titled: Method of and Means for Following Oil Wells, discloses means for maintaining oil flow while filtering petroleum through the use of packing having a specific gravity at least twice the specific gravity of the petroleum bearing stratum. Iron balls are identified as a preferred packing material.

Several of the references above disclose the use of well packings for the purpose of filtering out sand or other well debris flowing into producing wells. Other references discuss the use of packing to reduce well cavity space as a fire or explosion precaution. However, these references do not address the use of specifically designed well packing as a means of protecting well components from damage in case of fire.

There is a need for a means of protecting the structural components of both injection wells and production wells used for hydrocarbon recovery from damage which can occur during a well fire or a fire in a substrate near a well, either of which cause thermal stress and possible burning of such structural components. The means available prior to the present invention were not always reliable because they required an active response to an indication of the fire. The present invention provides passive protection of the well structural components.

SUMMARY OF THE INVENTION

In accordance with the present invention a method and means for passive protection of wellbore structures and the equipment used therein is provided in the form of a specialized packing system which is placed in the wellbore below ground level, and preferably below the packer. The packing particle size is a critical feature of the invention. Particle size distribution and packing placement within the wellbore as a function of particle size are additional features of the invention which can be tailored to the application. The packing material can be any non combustible material, although non-combustible materials which change in chemical or physical structure in a manner which consumes heat (which are endothermic) are preferred.

The size of the packing should be sufficiently large that the packing has a reasonably small impact on the pressure required to inject fluids into the formation (in the case of an injection well) or a reasonably small impact on the pressure of fluid hydrocarbons entering a well (in the case of a production well). At the same time, the size of the packing must be sufficiently small to provide adequate heat transfer surface per volume of packing, to provide the quenching action desired in the case of a well fire.

The maximum particle diameter of a sphere to be used as packing within a given wellbore is defined by the following particle size diameter equation:

$$Dp = \frac{0.17W - a(OD - 2th_w)}{OD}$$

Where:

$D_p$=diameter of the sphere (in.)

W=weight of casing (lb. steel/ft.)

OD=outside diameter of the casing (in.)

$th_w$=thickness of casing wall (in.)

a=design factor based on the safety factor required. The range of a was empirically determined, and is from at least about 0.001 to about 1.0.

A minimum spherical diameter of about 0.08 inches is preferred, to avoid packings that result in unacceptable pressure gradients.

For non-spherical packing, the size of the individual packing element can be related to a spherical diameter equivalent by the following packing size equivalent diameter equation:

$$Dp = 6\frac{V_p}{S_p}$$

Where:

$D_p$=diameter of a sphere from the equation above (in.)

$V_p$=volume of the non-spherical particle (in.$^3$)

$S_p$=surface area of the non-spherical particle (in$^2$)

The particle size distribution is limited to consist essentially of particles having a largest particle volume which is less than about 6 times the volume of the smallest particle. The preferred particle size distribution consists essentially of particles having a largest particle volume which is less than about 1.5 times the volume of the smallest particle.

In the most preferred embodiment of the present invention, the placement of packing in the well can be at locations from just below ground level to the very bottom of the wellbore (the rat hole). The following zones within the subterranean well are identified relative to the present invention, in descending order within the well: a free zone, a packer protection zone, a casing quench zone, a pay or formation zone, and a rat hole. The length of each zone and the point within the wellbore at which the zones begin depend on the well design.

The free zone begins below the packer and extends the distance from the bottom of the packer to the top of the packing. The free zone can be any length and may not exist in some applications.

The packer protection zone extends from the top of the packing down to the casing quench zone, and is designed to prevent heat of combustion from migrating to the packer. The packer protection zone is typically at least 10 ft. in length.

The casing quench zone extends from the bottom of the packer protection zone downward to the upper portion of the pay zone or formation zone, and provides protection from propagation of a casing fire above the pay zone. A typical casing quench zone ranges from about 2 ft to about 100 ft. in length.

The length of the pay zone or formation zone depends on the geological formation in general, and the rat hole is minimal in size as necessitated by well mechanics (a typical rat hole length ranges between about 5 ft. and about 30 ft).

The size range of packing particles placed in each zone is shown in the table below as a function of the empirically determined design factor, "a", of the particle size diameter equation given above:

| Zone | "a" Range |
|---|---|
| The free zone contains no packing. | |
| Packer Protection | 0.001–.05 |
| Casing Quench | 0.3–1.0 |
| Pay or Formation Zone | 0.05–.1 |

The rat hole "a" is such that $D_p > 0.08$ in. for the Rat Hole.

For a given well casing structure, one skilled in the art can now calculate the packing particle size to be used in each zone using the information provided above. The packing material particle size was empirically determined to be capable of extinguishing carbon steel fires in a simulated injection well. In the simulated injection well, a high pressure, high purity oxygen atmosphere was used in contact with the inside volume of a simulated wellbore to evaluate the ability of different packing systems to quench carbon steel casing fires.

DETAILED DESCRIPTION OF THE PREFERRED EMBODIMENTS

Figure 1:
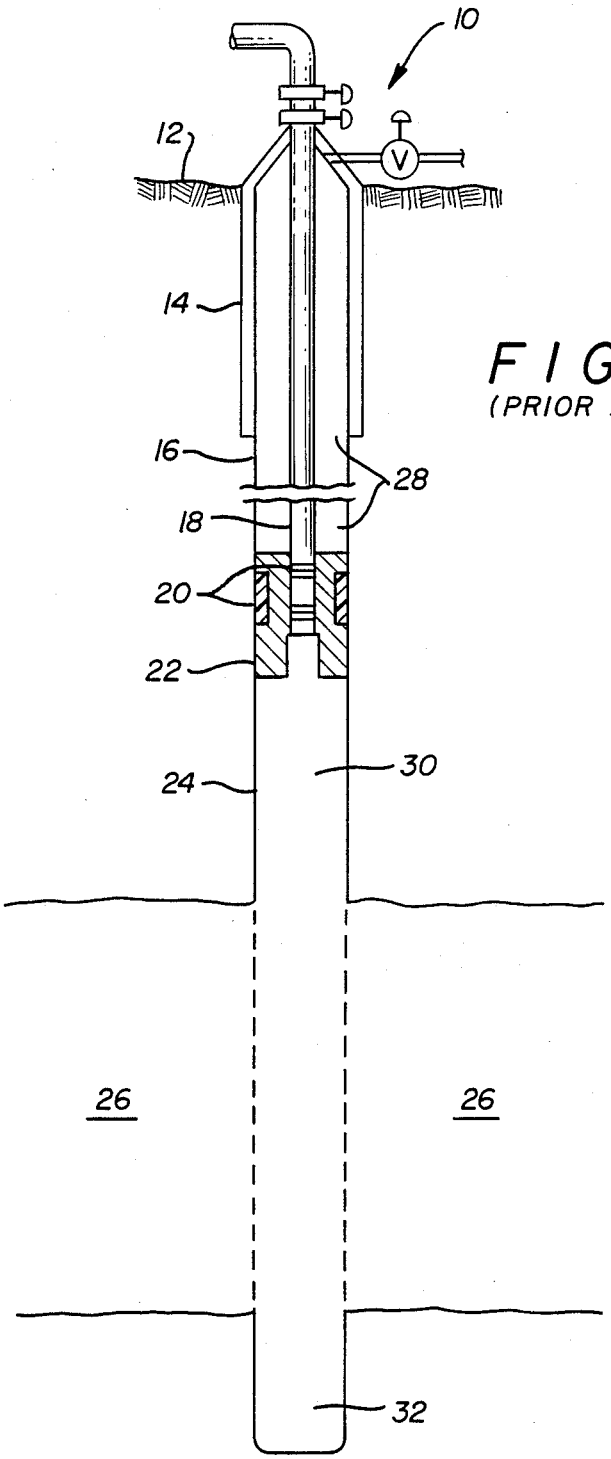
FIG. 1 (PRIOR ART)
FIG. 1 shows a typical injection well 10 of the type well known in the art, including surface casing 14, casing 16, tubing 18, seals 20, packer 22, lower casing 24, pay or formation zone 26, and rat hole 32.
Figure 2A:
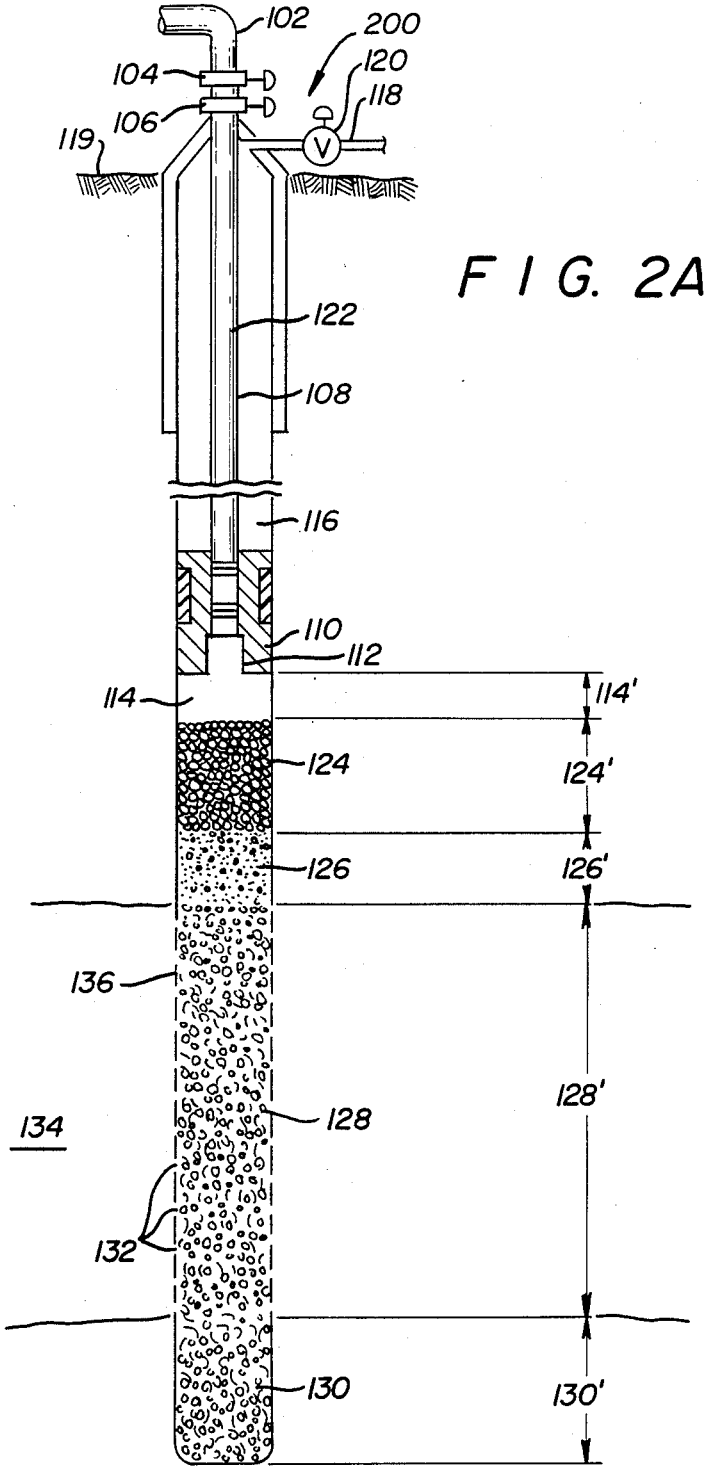
FIG. 2A shows a similar injection well 200 which includes the packing structure of the present invention. The zones shown in FIG. 2A include a free zone 114, which begins directly beneath packer 110, which free zone in followed in descending order within the well by packer protection zone 124, casing quench zone 126, pay or formation zone 128, and rat hole zone 130.
Figure 2B:
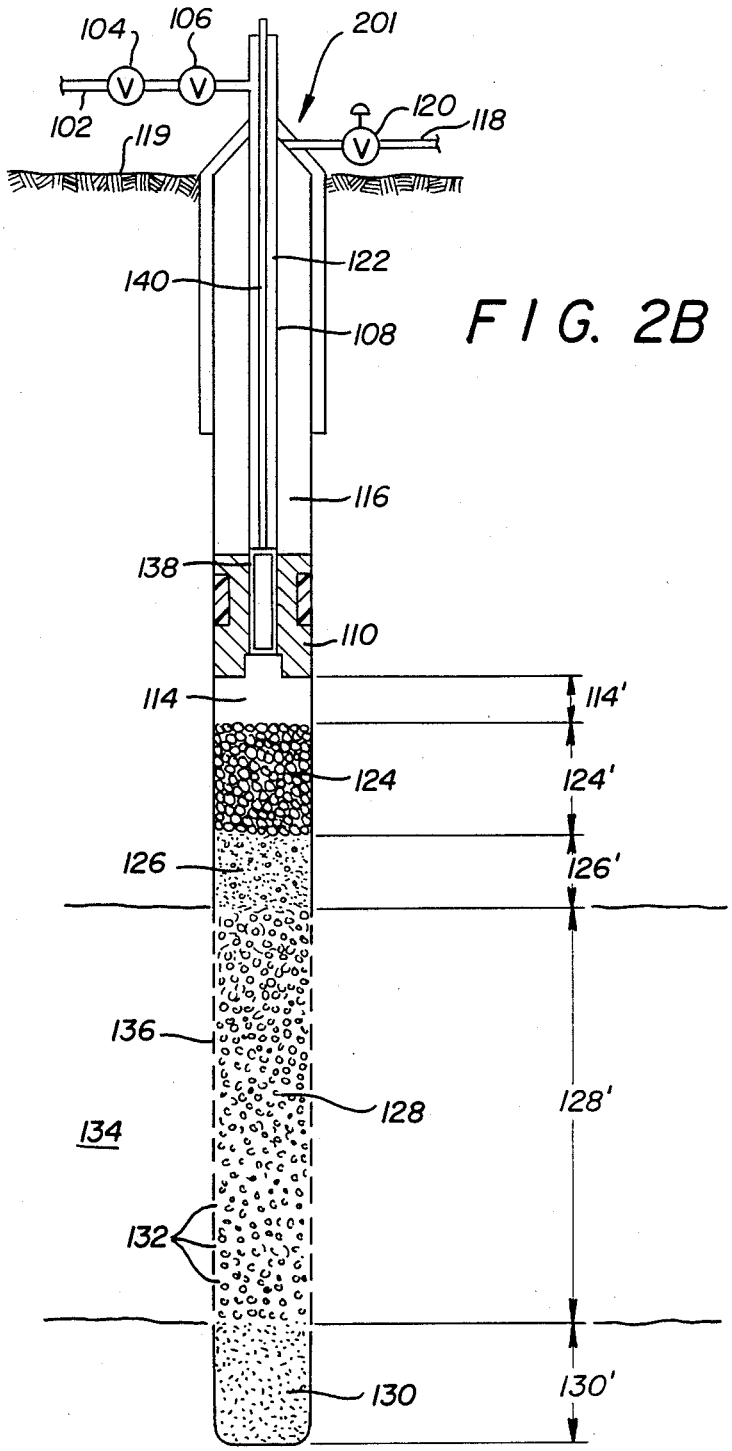
FIG. 2B shows a production well 201 in a manner similar to the injection well shown in FIG. 2A, wherein the packed zones are essentially the same, and wherein the production well includes a pump 138, a sucker tube 140, and valving arrangements above ground which differ from those of the injection well.

The present invention pertains to packing which can be used in injection wellbores in general, and in some production wellbores, for the recovery of hydrocarbons. As previously stated, the packing particle size and distribution and the packing placement within the wellbore are the principal features of the preferred embodiment of this invention. FIGS. 2A and 2B show the general embodiment of the invention for injection and production wells, respectively, which have packing only below packer 110. Although, packing can be used at any position within the well below ground level, the preferred use of packing is below packer 110.

The free zone 114 provides space for the expansion and contraction of the layers of packing within the well casing below packer 110. Even if no free zone 114 is planned, one will form over time due to settling of the particles. The free zone length is not of critical importance to the design of the packing system of the present invention.

The packer protection zone 124 is designed as a heat sink to control the amount of heat transfer to packer 110. Preferably, packer protection zone 124 ranges from about 10 to about 50 feet in length for heavy oil recovery applications.

The casing quench zone 126 is designed to prevent carbon steel casing fires from propagating up the well. Preferably, casing quench zone 126' ranges from about 10 feet to about 25 feet in length for the heavy oil recovery applications.

The pay zone 128 extends the length of the hydrocarbon bearing zone, and the purpose of the packing in zone 128 is to reduce available space for hydrocarbon accumulation within the well and to provide a heat sink which prevents ignition of the well casing. A secondary function of the packing in pay zone 128 is to support overlaying packing.

The rat hole 130 is designed to collect debris which enters wellbore. Rat holes are particularly useful in heavy oil production wells where the debris tends to settle to the bottom of the bore. Although rat holes are frequently present in injection wells, it is possible to have an injection well which does not utilize a rat hole.

In the most preferred embodiments of the present invention, several different packing particle sizes are utilized and the size of packing particles in each zone is designed within a range which provides empirically determined fire quench protection for the well equipment. There are however, factors in addition to protection of the well equipment which are important in the design of the packing. For example, the particle diameter in packer protection zone 124 should provide a good heat sink while simultaneously maintaining a low pressure drop in fluids flowing through this area. Since pressure drop is the controlling feature at this zone, the largest particle size packing is placed at this location within the well. The particle diameter in casing quench zone 126 is the smallest diameter packing within the portion of the wellbore which functions as the passive protection system for well components in case of fire (excluding the rat hole). The smaller particles provide increased surface area per packing volume, and thus faster heat transfer to the packing when needed to quench a well casing fire. Since manly gases are flowing through an injection well or a gas production well, the pressure drop effect of the smaller particles in casing quench zone 126 can be tolerated in these wells better than in an oil production well, where the particles in zone 126 may have to be slightly larger by comparison. In the case of a light oil production well, it is likely the particle size in quench zone 126 will be about the same size as that in packer protection zone 124. The length of the casing quench zone is a tradeoff between allowable pressure drop and the desired level of protection.

The particle size of the packing in pay zone 128 for an injection well or gas well is likely to be intermediate between the particle size of packer protection zone 124 and casing quench zone 126. There is competition between the desire to have a smaller particle size and good heat transfer to stop the fire at the formation level and the desire to have the lower pressure drop which is inherent in a larger particle size. In formation zone 128 there is the additional consideration that the particle size should be either at least 10% smaller than or 10% larger than the diameter of perforations 132 in the well shaft, to prevent blocking of fluid flow to (injection well) or from (production well) the formation. In the most preferred embodiments for an injection well or gas well, the packing particle size in rat hole 130 is the smallest in the well, because it is desired to minimize the volume available for hydrocarbon occupancy. There is no pressure drop problem created by the small particle size, since fluid flow down from the injection well or up through the production well does not pass through rat hole 130. However, the size of rat hole packing is not a critical feature of the present invention.

The packing is comprised of materials which are non-combustible for the environment being considered. For air injection applications, carbon steel or stainless steel as well as ceramic, gravel, sand, glass beads, limestone (calcium carbonate) and other similar materials can be used as packinq. For oxygen enriched air injection, wherein the oxygen content is qreater than about 25 percent to about 35 percent, carbon steel, stainless steel, and other similar materials should not be used for packing because they can burn. For such oxygen enriched air injection cases, preferred packing materials include ceramics, gravel, sand, glass beads limestone, and other materials which tend to be non-combustible in the environment.

Some types of packing material are endothermic (react in the environment to consume heat), and such materials are particularly useful. Examples of these materials include limestone (which not only uses heat to liberate carbon dioxide, but the carbon dioxide acts to quench combustion); perlite, which can comprise water which can be liberated and then vaporized. These endothermic materials provide an increased heat sink over that provided by materials which simply consume heat in the form of an increase in mass temperature.

It is also helpful to use packing materials which are able to withstand either the acid or caustic washings which are used to remove foreign materials or build up of chemical materials which tend to plug flow paths. The packing should also be able to be removed from the well by commonly used oil field procedures such as water recirculation.

EXAMPLE 1

In an embodiment for the prevention of or at least control of well fires through the use of packing, FIG. 2A shows a schematic of an injection well which serves as reference. Referring to FIG. 2A, injection gas containing a fraction of oxygen added for enhancement is introduced into injection well 200 through conduit 102. The gas flows through valves 104 and 106 into conduit 108 which transfers the gas through packer 110 and conduit 112 to free zone 114. Packer 110 seals off annulus region 116 from free zone 114. Annulus region 116 is typically filled with water, air, or an inert gas which is introduced through conduit 118 via valve 120. Region 116 is maintained at a hiqher pressure than the pressure within conduit 108 to ensure that in the event a leak develops, flow will be from region 116 into region 122 within conduit 108. The water, nitrogen or other inert gas typically contained in region 116 is used to provide a quench medium for zones 114 through 130 in the event of a well fire.

Directly beneath free zone 114, the well gas flows through packer protection zone 124', which is approximately 50 ft. in length. This zone is filled with ceramic aluminum oxide balls having a mean diameter falling within the range defined by the maximum packing particle diameter equation when "a"=at least about 0.001. The volume of the largest size ball is less than about 1.5 times the volume of the smallest ball (the most preferred particle distribution).

Subsequent to packer protection zone 124, the gas flows through casing quench zone 126 in which the packing is also aluminum oxide balls, but of a smaller size, wherein "a"=about 0.4. Casing quench zone 126' is about 10 ft. in length.

After casing quench zone 126, the gas passes through pay zone 128 in which the packing is also aluminum oxide balls, but of an intermediate size, wherein "a"=about 0.05. The aluminum oxide balls in pay zone 128 are about 10 percent smaller in diameter than the diameter of perforations 132 in the well shaft walls. The gas flows through perforations 132 into formation 134, where the gas is used to sustain combustion of the fire front.

The rat hole 130 beneath pay zone 128 contains aluminum oxide spheres having a diameter of about 0.08 in.

In zones 124 through 128, the packing provides a heat sink as well as a reduction in free volume which otherwise could be occupied by hydrocarbon containing liquids and gases. Consequently, if temperatures in these zones reach the ignition temperature of the hydrocarbons, the temperatures experienced by the casing will be lower due to heat absorption of the packing, and the combustion period, if any, will be short due to the limited quantity of fuel available.

The pay zone 128 and rat hole 130 are the most likely locations for injection well fires because of the near proximity of hydrocarbon in the formation and the potential for hydrocarbons to backflow into the injection well due to gravity effects. If a fire starts in these zones in an unpacked well, large quantities of fuel may be available to heat the casing materials to temperatures beyond which they lose their structural characteristics. In the case of oxygen enriched air in situ combustion, the casings may begin to burn. The heat of combustion will eventually raise the temperature of the seals in packer 110, which will release the inert fluid contained in region 116 to quench combustion. However, significant damage occurs and repair costs are incurred in putting the well back into service. Packing zones 128 and 130 with the aluminum oxide balls reduces the volume of fuel these regions can hold by about 50 percent to about 75 percent. The heat capacity and thermal conductivity of the aluminum oxide spheres reduces the maximum temperature experienced within the well and thus the temperature experienced by casing 136. The migration of heat to packer 110 is substantially slowed, and the relatively low temperature and heat capacity of the injection gases flowing into the well shaft provides cooling in packer protection zone 124 and in casing quench zone 126. Should casing 136 below in pay zone 128 begin to burn, the smaller aluminum oxide spheres in casing quench zone 126 provide additional surface contact with casing 136 at the level of quench zone 126 to more effectively quench the burning at that level, reducing the amount of injection well tubulars damaged by the fire.

When the fire is not one which occurs within the wellbore itself, but is the result of burn back from a formation area outside the well, the packing in pay zone 128 provides a heat sink to absorb much of the heat transferred from outside the well to casing walls 136. If the temperatures rise high enough for ignition of the casing 136 at pay zone 128, the packing in casing quench zone 126 is frequently adequate to quench combustion of casing 136 above formation level 134.

EXAMPLE 2

The following describes the parameters of a typical embodiment of an injection well utilizing the packing of the present invention wherein the packing is comprised of a single particle diameter size.

(a) Gas Flow is about 350,000 million standard cubic feet per day.
(b) Injection Pressure for an empty well is about 1,500 psia.
(c) Casing Outside Diameter is about 5.5 in.
(d) Casing Weight is about 17 lb./ft.
(e) Casing Thickness is about 0.304 in.
(f) Diameter of Perforations in casing is about 0.375 in.
(g) Permeability of the Formation is about 92 millidarcies.
(h) Formation Pressure is about 1,000 psia.
(i) Formation Thickness is about 20 ft.

For this set of parameters, a suitable packing comprises:

| Zone | "a" Value | Length (ft.) | Maximum* Diameter (in.) | Selected Diameter (in.) | Pressure Drop Increase (psi) |
|---|---|---|---|---|---|
| 124 | .001 | 50 | .52 | .19 | 20 |
| 126 | .001 | 10 | .52 | .19 | 5 |
| 128 | .001 | 20 | .52 | .19 | 20 |
| 130 | .001 | 10 | .52 | .19 | — |

The increase in pressure drop across the well due to the presence of the packing is about 45 psia, compared with a total injection pressure requirement of about 1,545 psia.

The pressure drops provided in Example 2 were calculated using models developed for flow through packed towers and porous media. The calculated pressure drop represents only about a 0.5 percent increase in compression power when compared with an unpacked well.

The packing described above can also be used for gas production wells due to the low pressure drop experienced across the packing, and can be used for light oil production wells; although the pressure drop across a light oil production well will be considerably higher.

EXAMPLE 3

As previously discussed, in the case of an injection well, the preferred packing comprises more than one particle size diameter. This example provides a listing of well parameters and the recommended packing for an injection well when more than one packing particle size is used.

(a) Gas Flow is about 350,000 standard cubic feet per day.
(b) Injection Pressure for an empty well is about 1,500 psia.
(c) Casing Outside Diameter is about 5.5 in.
(d) Casing Weight is about 17 lb./ft.
(e) Casing Thickness is about 0.304 in.
(f) Diameter of Perforations in casing is about 0.375 in.
(g) Permeability of the Formation is about 92 millidarcies.
(h) Formation Pressure is about 1,000 psia.
(i) Formation Thickness is about 20 ft.

For this set of parameters, a preferred packing comprises:

| Zone | "a" Value | Length (ft.) | Maximum* Diameter (in.) | Selected Diameter (in.) | Pressure Drop Increase (psi) |
|---|---|---|---|---|---|
| 124 | 0.001 | 50 | .52 | .44 | 5 |
| 126 | 0.3 | 10 | .26 | .19 | 5 |
| 128 | 0.05 | 20 | .48 | .19 | 20 |
| 130 | 0.5 | 10 | .08 | .08 | — |

*Maximum diameter using the packing particle diameter equation.

The increase in pressure drop across the well due to the packing is about 30 psia, compared with a total injection pressure requirement of about 1,530 psia.

The pressure drops provided in Example 3 were calculated using models developed for flow through packed towers and porous media. The calculated pressure drop increase represents only about a 0.5 percent increase in compression power when compared with an unpacked well.

Figure 3:
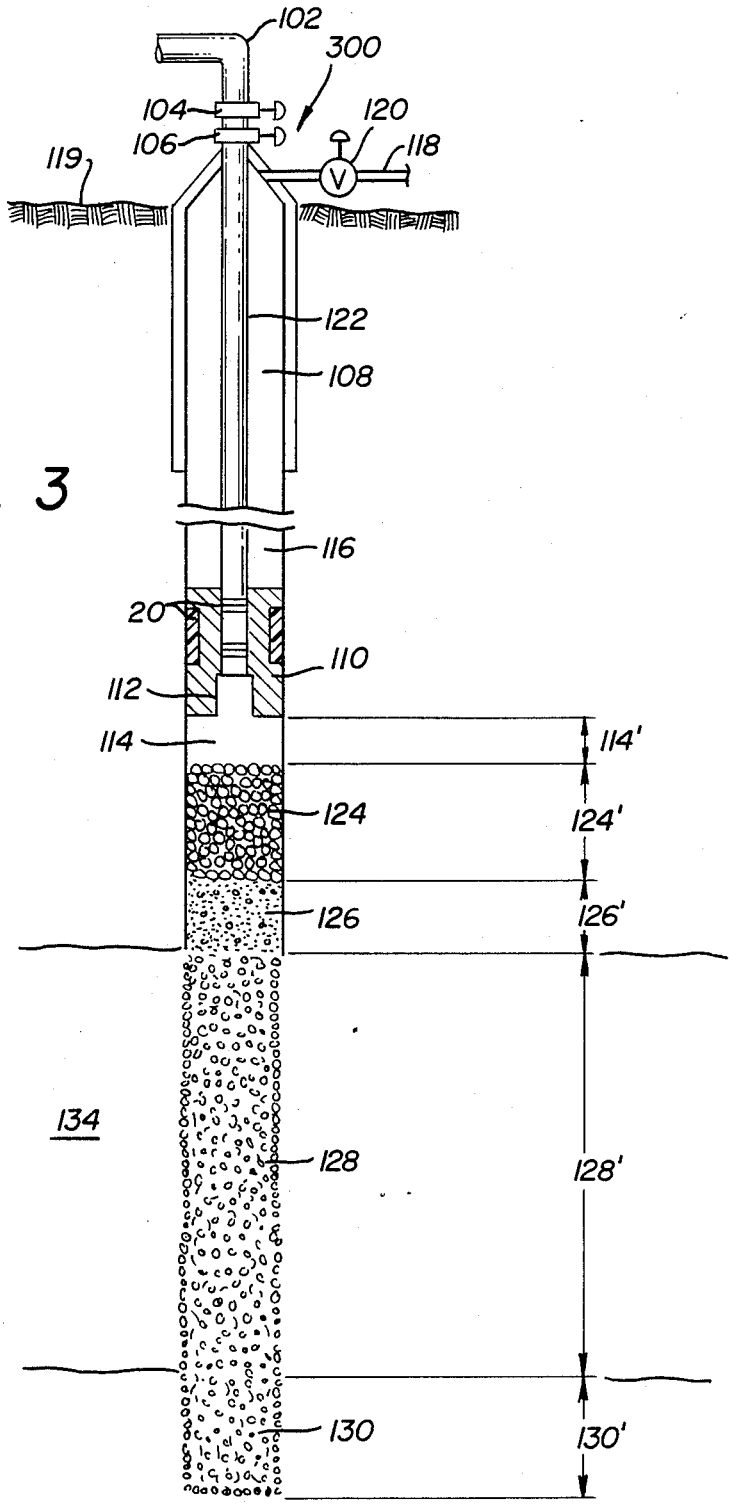
FIG. 3 shows an injection well 300 modified to have an "open hole" completion. There is no casing surrounding pay zone 128 which is bordered by formation 134.

Numerous variations are possible within the structure and method of well packing as disclosed herein, as long as the critical requirement reqarding the relationship between particle size and well casing parameters is met. Particle size distribution, and position of placement of packing in the well as a function of particle size are significant variables which can be tailored to the application. For example, FIG. 3 shows a preferred embodiment 300 in which an "open hole" completion is used; there is no casing surrounding zones 128 and 130. In this embodiment, the packing provides structural support to the formation as well as protection for casing 142 (and indirectly for packer 110). Packing in zones 128 and 130 only may be larger than defined by the packing size diameter equation when the open hole completion is used. In addition, the bore hole in zone 128 may be reamed out to larger diameters to improve injectivity or productivity depending on whether the well is an injection or a production well. For example, casing 142 may be 7 inches in diameter and the bore hole in zone 128 may be underreamed to 2 feet in diameter.

Figure 4:
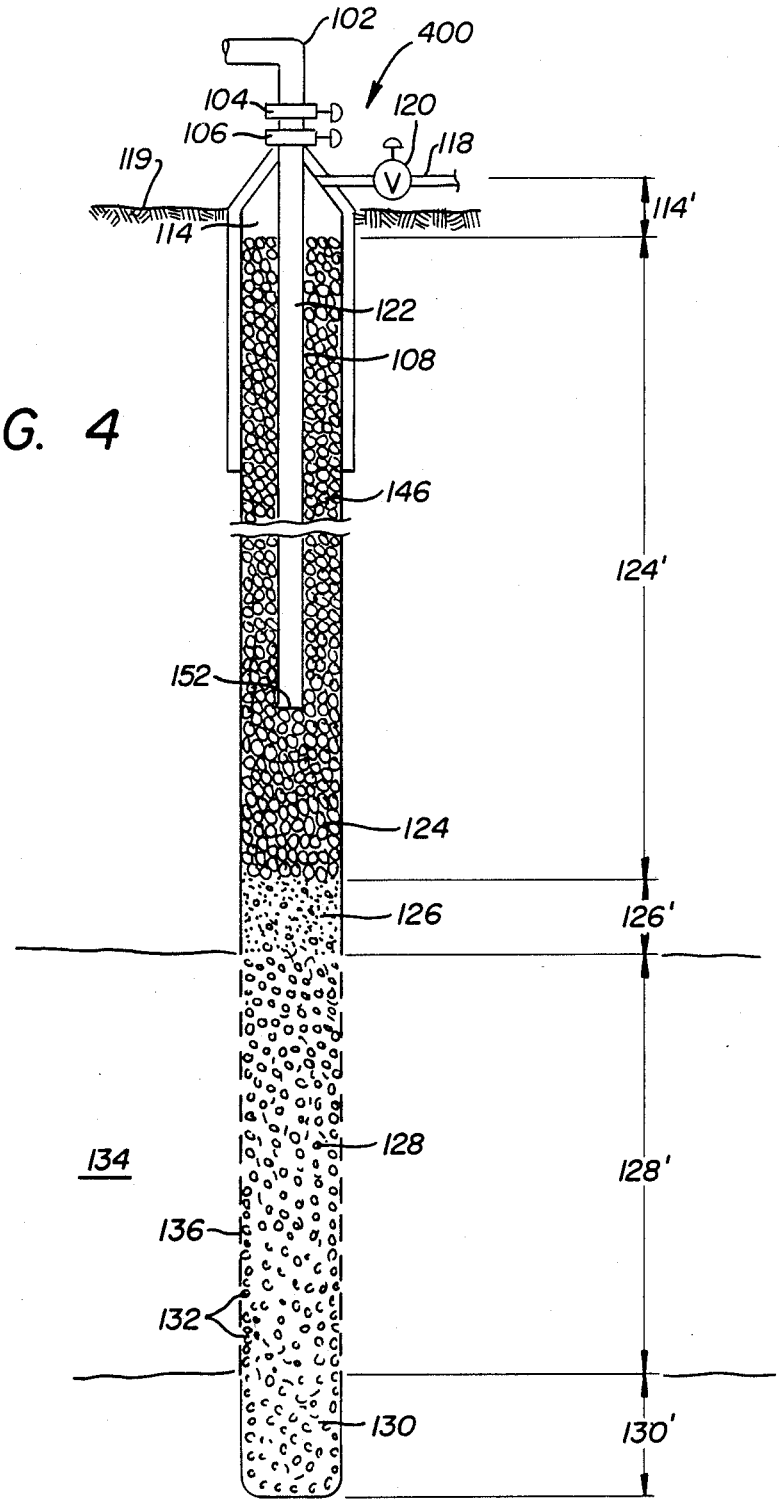
FIG. 4 shows an injection well 400 wherein packer 110 (as shown in FIG. 2A) has bee eliminated and replaced with packing.

Another preferred embodiment of the well packing of the present invention is shown in FIG. 4. An injection well 400 is depicted in which the packer (110 in FIG. 3) has been replaced with packing 146 to control potential combustion in the packer protection zone 124. Packer protection zone 124 has been expanded toward ground level 119, terminating at free zone 114 which extends from slightly below ground level 119 to packer protection zone 124. Since the tubulars for injection now extend beneath the packing, it is necessary to place a screen or slotted cover 152 at the end of the tubular to prevent packing from entering the opening to the tubular.

Figure 5:
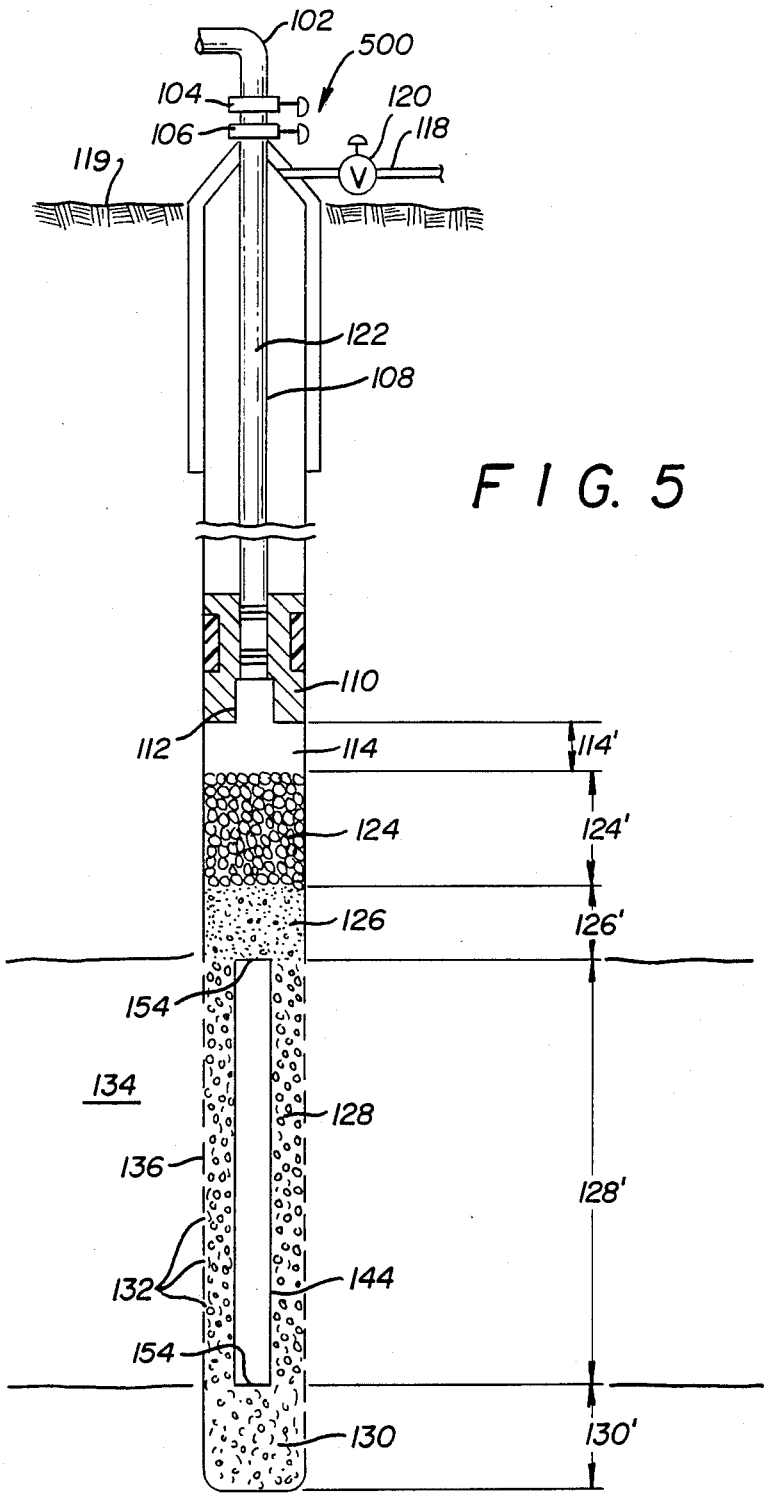
FIG. 5 shows an injection well 500 wherein a conduit 144 which may be screen-like in construction is used to replace a portion of the packing in pay zone 128.
Figure 6:
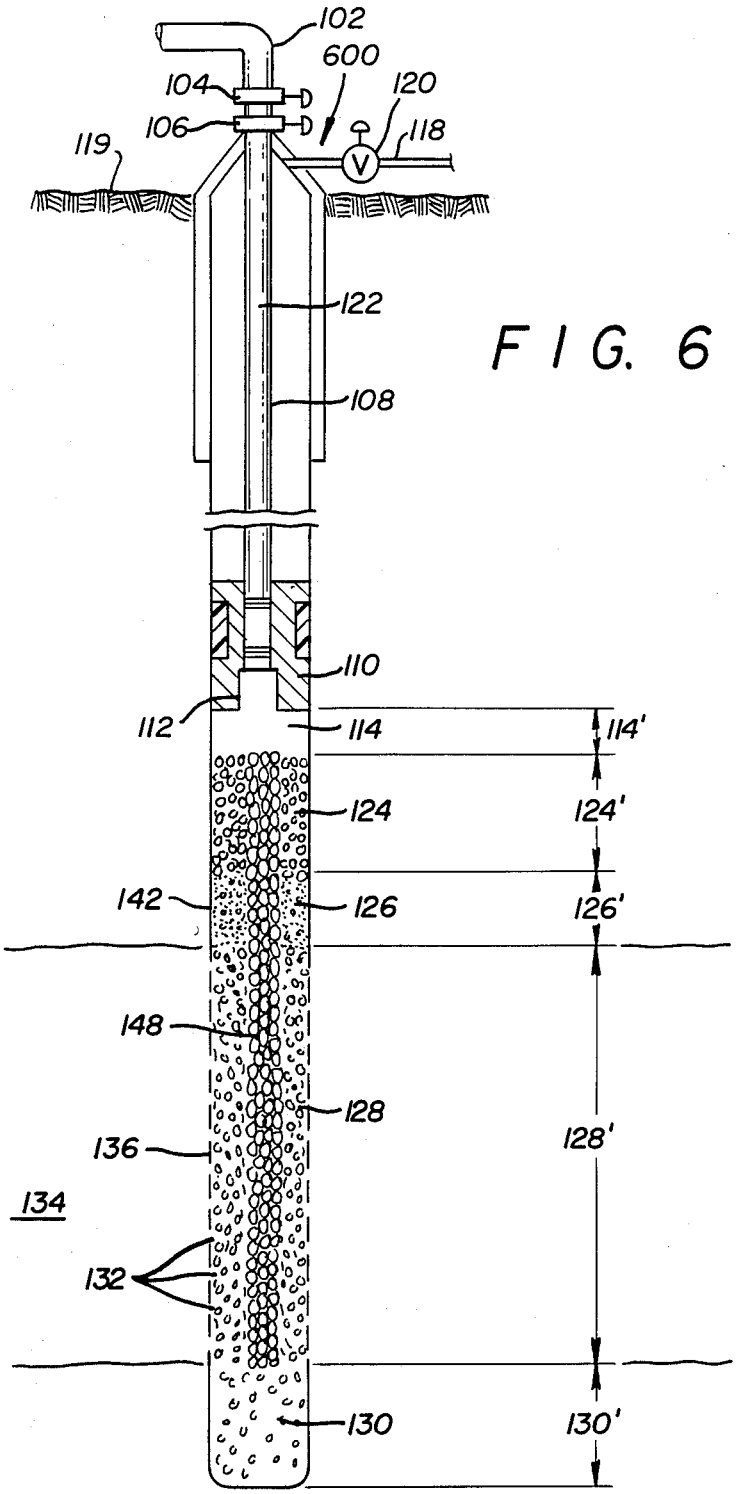
FIG. 6 shows an injection well 600 wherein the packing particle size diameter has been altered in a central core area 148 above zone 130, to reduce pressure drop. The particle size diameter in central core 148 typically is somewhat larger than that used in zone 128.

Depending on the pressure dynamics of the well in general, it may be necessary to reduce the pressure drop across the packing in the pay zone of the well which interfaces with the hydrocarbon source formation zone. The flow characteristics through this zone contribute a large share of the packing induced pressure drop. FIG. 5 shows an injection well 500 in which a portion of the packing in the center of the packing structure of pay zone 128 has been replaced by space holding structure 144 which may be constructed of a screen like material or a slotted liner wrapped in wire or similar construction which aids in reducing the pressure drop in the area of pay zone 128. Screened or slotted covers 154 are used at the open ends of space holding structure 144 to prevent packing from entering the openings. A closely related embodiment is shown in FIG. 6, wherein injection well 600 packing is comprised of a central core of packing 148 which has an effective diameter which is typically greater than the diameter of packing in pay zone 128. The larger effective diameter packing in central core 148 acts to reduce the overall pressure drop induced by the packing. Central core packing 148 can extend the entire length of the packed zones above the rat hole, as shown in FIG. 6, or can be used in a particular zone only, such as pay zone 128.

Figure 7:
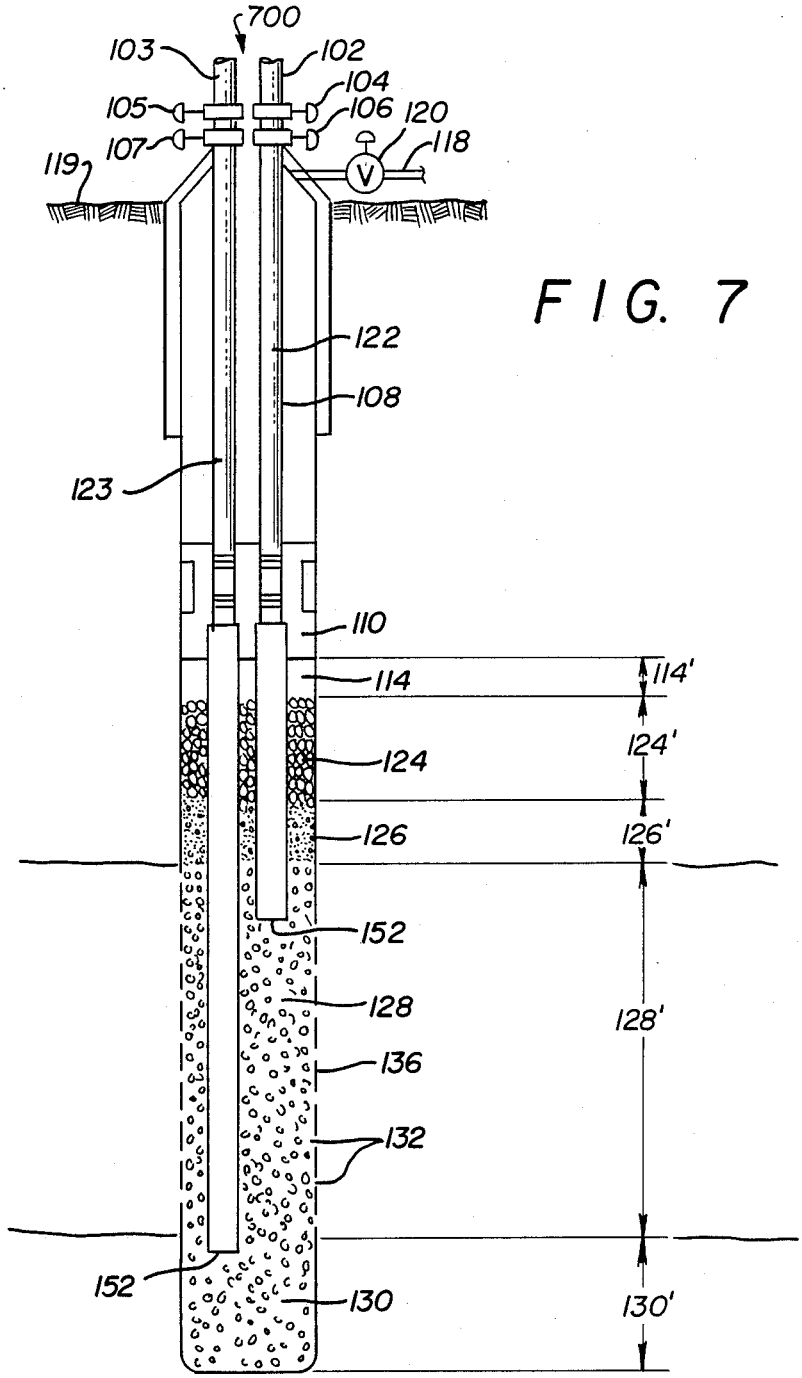
FIG. 7 depicts an injection well 700 which comprises multiple injection strings.

There are a variety of well internal element designs which are used. Several of the more common designs comprise multiple tubulars. FIG. 7 shows injection well 700 which comprises multiple injection strings 122 and 123. The tubulars below packer 110 can be filled with packing or can be devoid of packing, in which case a screen or similar device is used at the bottom of the tubular to prevent packing from entering the tubular.

The packing systems described herein provide significant advantages over alternative means of protecting wells from fire damage. The use of packing permits the safe use of carbon steel casing, significantly reducing the costs of installing and maintaining a well. The cost of packing materials is relatively low. The packing system is much simpler, less costly, and more reliable than the use of a temperature sensing device in combination with a flood/quench technique. In addition, use of the packing system in injection wells would permit initiation of combustion using gases have the desired oxygen concentration without the necessity of using more expensive techniques in which air is used to initiate combustion, followed by blend-up to design purity.

Only the most preferred embodiments of the invention have been described above, and one skilled in the art will recognize that numerous substitutions, modifications and alterations are permissable without departing from the spirit and scope of the invention as demonstrated in the following claims:

I claim;

1. A well packing structure for use in an injection well having a casing or in a gas or light oil production well having a casing, wherein said packing structure is positioned beneath ground level within at least some of the casing and wherein said packing particle diameter maximum size is defined by the equation:

$$Dp = \frac{0.17W - a(OD - 2th_w)}{OD}$$

wherein,

Dp=diameter of a spherical shaped particle (in.)

W=weight of the well casing (lb/ft.)

OD=outside diameter of the well casing (in.)

$th_w$=thickness of the casing wall (in.) and wherein "a" is at least about 0.001 and at most about 1.0.

2. A well packing structure for use in an injection well having a casing or in a gas or light oil production well having a casing, wherein said packing structure is positioned beneath ground level within at least some of the casing, wherein said structure comprises a series of zones including a formation or pay zone, and wherein the packing particles above the formation or pay zone are comprised of a maximum size diameter defined by the equation:

$$Dp = \frac{0.17W - a(OD - 2th_w)}{OD}$$

wherein,

Dp=diameter of a spherical shaped particle (in.)

W=weight of the well casing (lb/ft.)

OD=outside diameter of the well casing (in.)

$th_w$=thickness of the casing wall (in.) wherein "a" ranges from about 0.001 to about 1.0, and wherein said series of zones above the formation or pay zone comprises a packer protection zone wherein "a" in the particle size diameter equation ranges from about 0.001 to about 0.05, and a casing quench zone wherein "a" ranges from about 0.3 to about 1.0.

3. The well packing structure of claim 1 or claim 2, wherein the packing has a particle size distribution such that the volume of the largest particle is less than about 6 times the volume of the smallest particle.

4. The well packing structure of claim 1 or claim 2 wherein said packing particles are comprised of non-combustible materials selected from the group consisting of carbon steel, stainless steel, ceramic, gravel, glass beads, sand, limestone and combinations thereof.

5. The packing structure of claim 1 or claim 2 wherein said packing particles are comprised of non-combustible materials selected from the group consisting of ceramics, gravel, sand, glass beads, limestone and combinations thereof.

6. The packing structure of claim 4 wherein said packing particles are comprised of non-combustible materials which are endothermic, whereby the chemical or physical structure of the packing material is altered in a manner which consumes heat, over the temperature range the packing would experience during a well fire or a fire in the vicinity of a well.

7. A well packing structure for use in an injection well having a casing or in a gas or light oil production well having a casing, wherein said structure is positioned within at least some of the casing beneath a well packer and wherein said structure comprises a series of zones, and wherein the packing particle maximum diameter in each zone is defined by the equation:

$$Dp = \frac{0.17W - a(OD - 2th_w)}{OD}$$

wherein

Dp=diameter of a spherical shaped particle (in.)

W=weight of the well casing (lb/ft.)

OD=outside diameter of the well casing (in.)

$th_w$=thickness of the closing wall (in.), and wherein, "a"=the value specified for the zones listed below:

(a) a packer protection zone wherein "a" ranges between about 0.001 and about 0.05;

(b) a casing quench zone wherein "a" ranges between about 0.3 and about 1.0; and, (c) a pay or formation zone wherein "a" ranges between about 0.05 and about 0.1.

8. The well packing structure of claim 8 including an additional zone:

(d) rat hole zone, wherein "a" is such that Dp is about 0.08.

9. The well packing structure of claim 7 or claim 8 wherein the particle size distribution is such that the volume of the largest particle is less than about 6 times the volume of the smallest particle.

10. The well packing structure of claim 7, wherein said packing particles are non-combustible and endothermic within the temperature range the packing would experience during a well fire or a fire in the vicinity of a well.

11. The well packing structure of claim 7 wherein said non-combustible packing particles are comprised of a material selected from the group consisting of carbon steel, stainless steel, ceramic, gravel, glass beads, sand, limestone, and combinations thereof.

12. The well packing structure of claim 7, wherein said non-combustible packing particles are comprised of a material selected from the group consisting of ceramic, gravel, glass beads, sand, limestone, and combinations thereof.

13. A method of packing an injection well having a casing or a gas or light oil production well having a casing with particles which provide passive protection of well casing and tubulars from well fires, said method comprising:

determining the maximum particle size diameter to be used for said packing using the equation:

$$Dp = \frac{0.17W - a(OD - 2th_w)}{OD}$$

wherein

Dp=diameter of a spherical shaped particle (in.)

W=weight of the well casing (lb/ft.)

OD=outside diameter of the well casing (in.)

$th_w$=thickness of the casing wall (in.) and wherein "a" is at least about 0.001 and at most about 1.0; and, placing non-combustible particles, no larger than the maximum particle size determined, within at least some of the casing below ground level.

14. The method of claim 13 wherein said well packing is placed below a well packet and is separated from said well packer by a free zone.

* * * * *

UNITED STATES PATENT AND TRADEMARK OFFICE

CERTIFICATE OF CORRECTION

PATENT NO. : 4,901,796

DATED : February 20, 1990

INVENTOR(S) : R.F. Drnevich

It is certified that error appears in the above-identified patent and that said Letters Patent is hereby corrected as shown below:

In column 6, line 2 delete "bee" and insert therefor --been--.

In column 7, line 11 delete "manly" and insert therefor --mainly--.

In column 7, line 51 delete "qreater" and insert therefor --greater--.

In column 10, line 58 delete "reqarding" and insert therefor --regarding--.

In claim 14, line 2 delete "packet" and insert therefor --packer--.

Signed and Sealed this

Eleventh Day of December, 1990

*Attest:*

HARRY F. MANBECK, JR.

*Attesting Officer*

*Commissioner of Patents and Trademarks*